US006910456B2

(12) United States Patent
Umemoto et al.

(10) Patent No.: US 6,910,456 B2
(45) Date of Patent: Jun. 28, 2005

(54) INTAKE MODULE HAVING INTEGRALLY HOUSED ECU

(75) Inventors: Satoru Umemoto, Kariya (JP); Masayuki Niwa, Kariya (JP)

(73) Assignees: Denso Corporation (JP); Toyoda Boshoku Corporation (JP)

( * ) Notice: Subject to any disclaimer, the term of this patent is extended or adjusted under 35 U.S.C. 154(b) by 0 days.

(21) Appl. No.: 10/341,248

(22) Filed: Jan. 14, 2003

(65) Prior Publication Data

US 2003/0142454 A1 Jul. 31, 2003

(30) Foreign Application Priority Data

Jan. 31, 2002 (JP) ..... 2002-022850

(51) Int. Cl.[7] ..... F02B 77/00
(52) U.S. Cl. ..... 123/198 E; 123/41.31
(58) Field of Search ..... 123/198 E, 198 R

(56) References Cited

U.S. PATENT DOCUMENTS 6,067,953 A * 5/2000 Bloomer ..... 123/198 E
6,167,862 B1 * 1/2001 Powell et al. ..... 123/198 E
6,318,329 B1 11/2001 Sato
6,341,063 B2 * 1/2002 Kinoshita et al. ..... 361/690
6,513,479 B2 * 2/2003 Nozaki et al. ..... 123/198 E
6,644,249 B2 * 11/2003 Itakura et al. ..... 123/41.31

* cited by examiner

*Primary Examiner*—Henry C. Yuen
*Assistant Examiner*—Jason Benton
(74) *Attorney, Agent, or Firm*—Nixon & Vanderhye PC

(57) ABSTRACT

An intake module for a vehicular engine has a casing that is constructed of an air cleaner housing portion and an electronic control unit (ECU) housing portion. The air cleaner housing portion that houses an air cleaner is mounted on the engine. The ECU housing portion that houses an ECU is connected with the air cleaner housing portion. A plurality of reinforcement ribs is formed on an outer periphery of the ECU housing portion.

33 Claims, 6 Drawing Sheets

INTAKE MODULE HAVING INTEGRALLY HOUSED ECU

CROSS REFERENCE TO RELATED APPLICATION

This application is based on and incorporates herein by reference Japanese Patent Application No. 2002-22850 filed on Jan. 31, 2002.

FIELD OF THE INVENTION

The present invention relates to an intake module, in which an electronic control unit (ECU) is integrally housed, for a vehicular engine.

BACKGROUND OF THE INVENTION

An intake module, in which an electronic control unit (ECU) is housed, used for a vehicular engine has been introduced. By integrally housing an ECU in an intake module, assembling steps can be reduced. The intake module is constructed of an air cleaner housing portion, an intake air passage portion, and an ECU housing portion. The air cleaner housing portion is fixed on an engine, and the ECU housing portion is positioned away from the engine to reduce the influence of heat.

When a vehicle is under service, a force may be applied to the ECU housing portion, for instance, a serviceperson put his or her hand on the ECU housing portion. As a result, the ECU assembly may be damaged. This creates a problem in engine control.

SUMMARY OF THE INVENTION

The present invention therefore has an objective to provide an intake module that includes a reinforcement member for an integrally housed ECU to tolerate with an external force.

An intake module of the present invention has a casing that is constructed of an air cleaner housing portion and an ECU housing portion. The air cleaner housing portion and the ECU housing portion are integrated, and the air cleaner housing portion is fixed on an engine. The ECU housing portion is not supported from the underneath but has a reinforcement member to improve the rigidity of the ECU housing portion. Therefore, the damage to the ECU in the ECU housing portion is reduced.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

The preferred embodiments of the present invention will be explained with reference to the accompanying drawings.

Figure 1A:
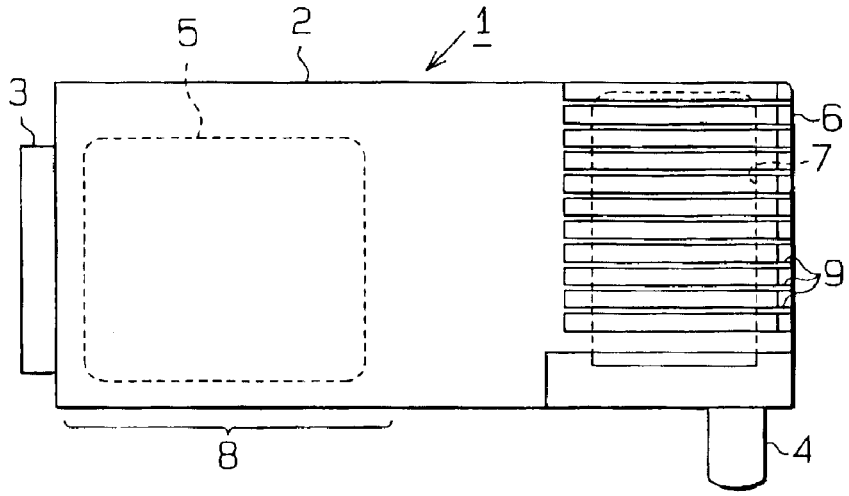
FIG. 1A is a top view of an intake module according to an embodiment of the present invention.
Figure 1B:
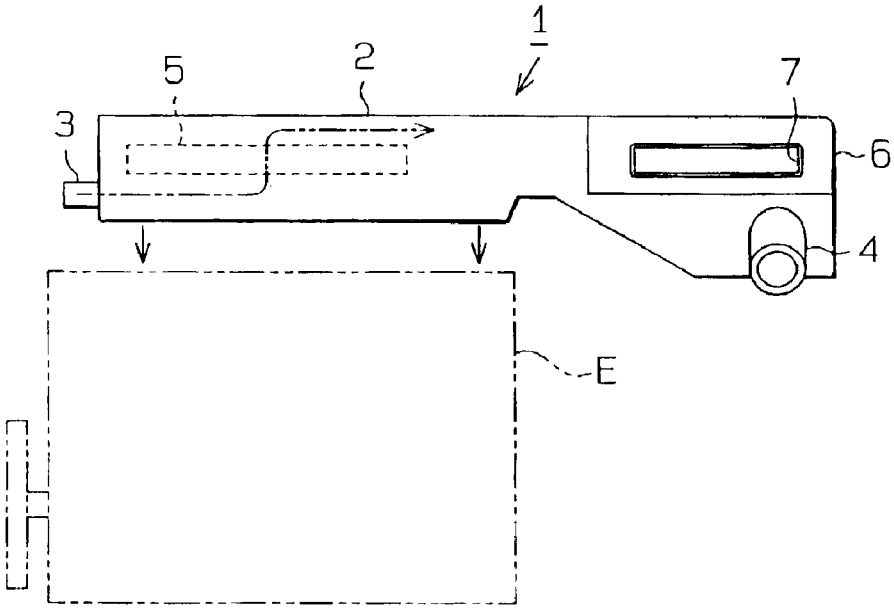
FIG. 1B is a front view of the intake module according.

Referring to FIG. 1, an intake module 1 includes a casing 2 which is made of a resin, such as polypropylene. The casing 2 has an air intake passage in the middle hollow part, an air inlet 3, and an air outlet 4. An air cleaner 5 is housed near the air inlet 3. The air flows into the air module 1 from the air inlet 3, passes through the air cleaner 5, and flows out of the intake module 1 via the air outlet 4. The air outputted from the intake module 1 is inputted to the engine E via an intake hose (not shown).

Figure 2:
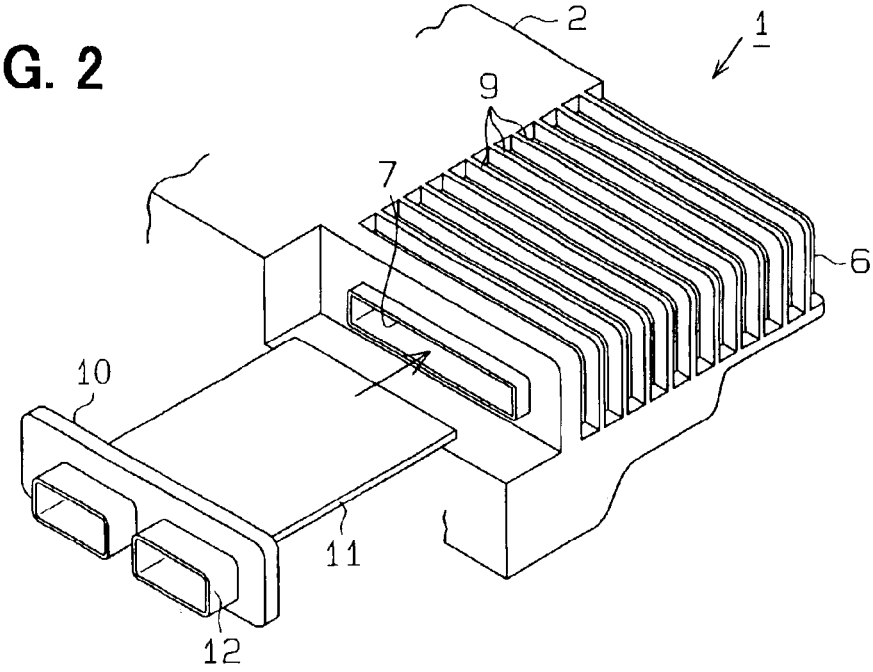
FIG. 2 is a perspective view of an ECU housing portion of the intake module.

The casing 2 further includes an ECU housing portion 6 for housing an ECU 10. The ECU hosing portion 6 has a slot 7, an opening of which is located on the side adjacent to the air outlet 4. A circuit board 11 of the ECU 10 is inserted into the slot 7 through the opening as shown in FIG. 2. The ECU 10 also has connectors 12.

Figure 3A:
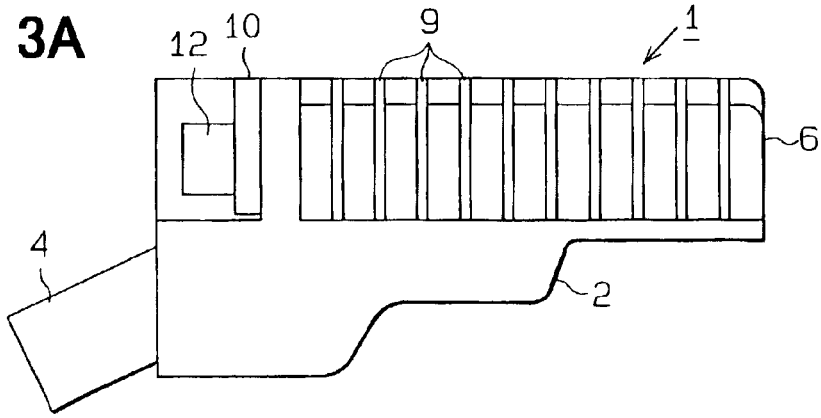
FIG. 3A is a side view of the ECU housing portion of the intake module.
Figure 3B:
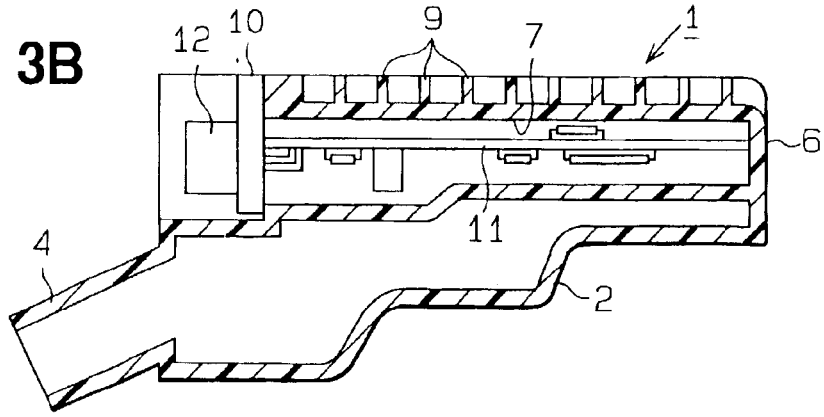
FIG. 3B is a cross-sectional side view of the ECU housing portion of the intake module.
Figure 4:
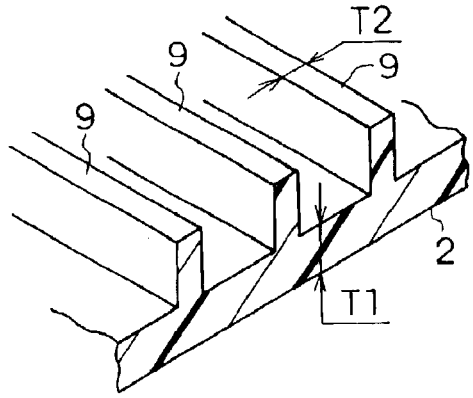
FIG. 4 is a perspective view of a part of reinforcement ribs including a cross section.

Referring to FIGS. 1 through 3, the ECU housing portion 6 has a plurality of reinforcement ribs 9 extended from the outer periphery. The reinforcement ribs 9 are formed together with the casing 2 when the casing 2 is formed. The reinforcement ribs 9 are evenly spaced in the longitudinal direction of the intake module 1. The thickness T2 of the reinforcement ribs 9 is thinner than the thickness T1 of the casing 2 as shown in FIG. 4. In general, a resin treated piece, such as the casing 2, has even thickness for convenience in molding.

Figure 5:
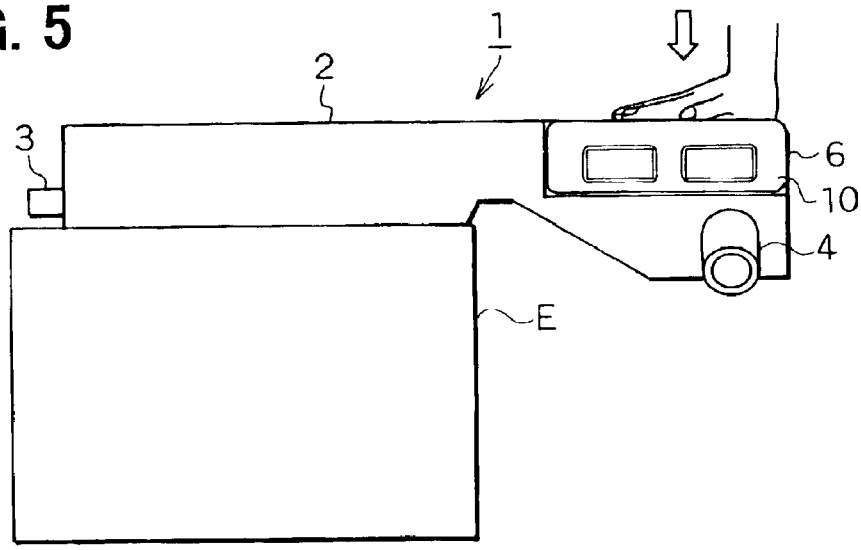
FIG. 5 is a front view of the intake module mounted on an engine.

An air cleaner housing portion 8 is fixed on the engine E with three or four mounting screws (not shown). The ECU housing portion 6 is not supported from the underneath. During service of a vehicle, a serviceperson may put his or her hand on the ECU hosing portion 6 as shown in FIG. 5. In that case, a downward force is applied to the intake module 1, as indicated with an arrow in FIG. 5. However, the strength of the ECU housing portion 6 is improved with the reinforcement ribs 9. Therefore, damages to the ECU 10 can be reduced.

Moreover, the reinforcement ribs 9 are provided parallel to the long side of the intake module, covering the ECU housing portion 6. Therefore, effective reinforcement can be provided. The thickness of the reinforcement ribs 9 is smaller than the thickness of the other part of the casing 2. Therefore, the heat radiation via the reinforcement ribs 9 is improved, and the operating condition of the ECU 10 is improved.

The present invention should not be limited to the embodiment previously discussed and shown in the figures, but may be implemented in various ways without departing from the spirit of the invention.

Figure 6:
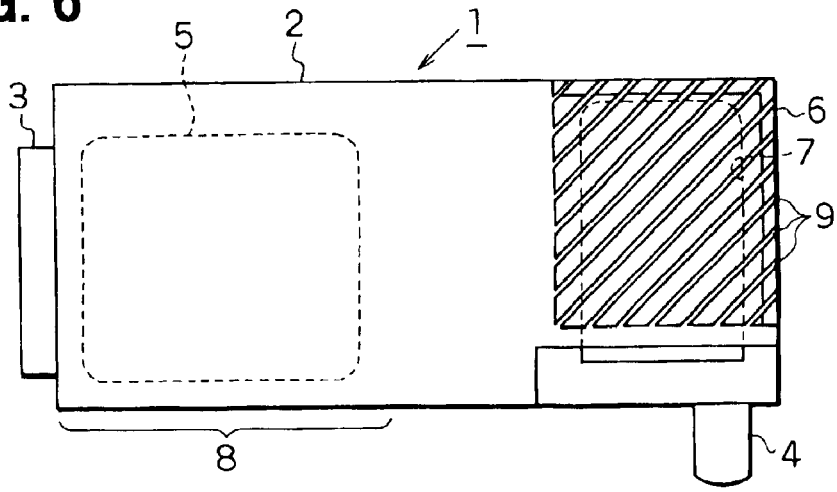
FIG. 6 is a top view of a modified intake module.

For example, the reinforcement ribs 9 are positioned at an angle with respect to the long side of the intake module 1 as shown in FIG. 6. The reinforcement ribs 9 may be unevenly spaced. Alternatively, the reinforcement ribs 9 can be in the form of lattice, or in patterns, such as a logo and a symbol. The reinforcement ribs 9 can be formed ornamentally. However, it is preferable that the reinforcement ribs 9 are arranged parallel to the long side of the intake module 1 to tolerate with the force applied to the intake module 1.

Figure 7A:
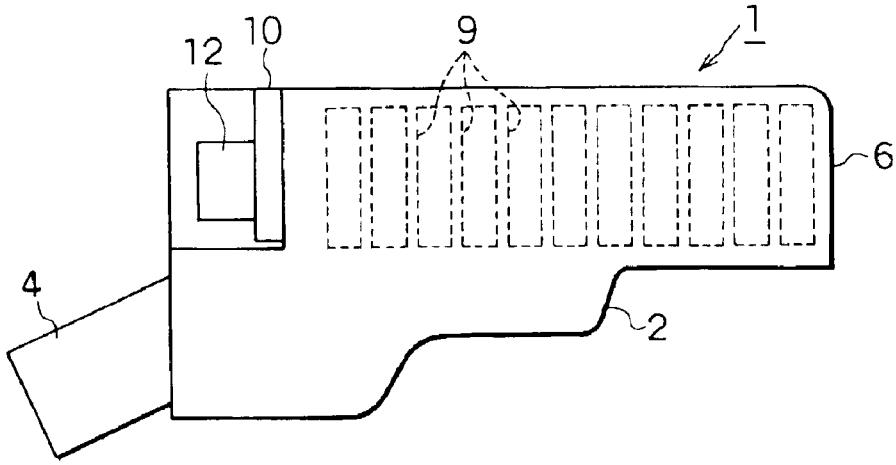
FIG. 7A is a side view of a modified intake module.
Figure 7B:
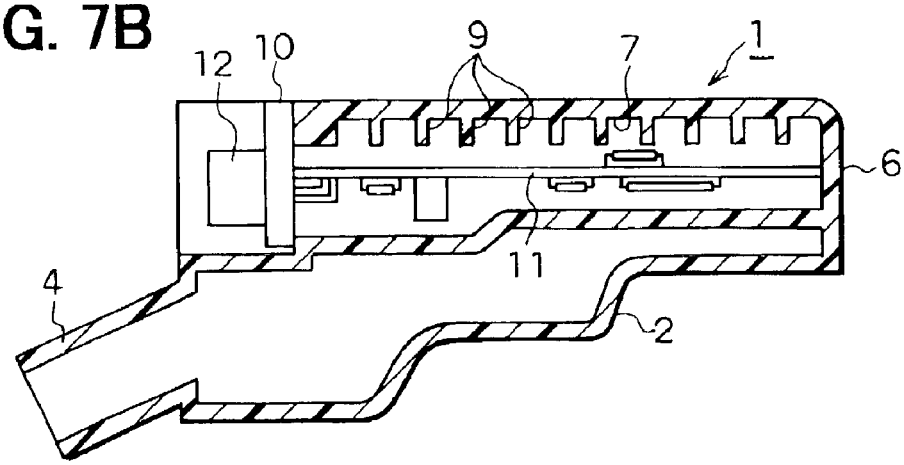
FIG. 7B is a cross-sectional side view of the intake module shown in FIG. 7A
Figure 8:
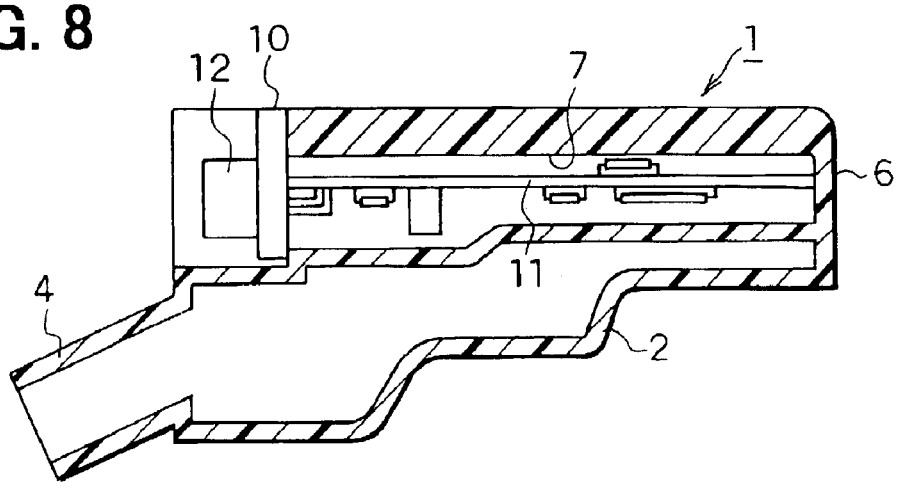
FIG. 8 is a cross-sectional side view of a modified intake module.

The reinforcement ribs 9 may be formed on an inner periphery of the ECU hosing portion 6 as shown in FIG. 7. Shapes and patterns of the ribs 9 can be arranged as same as in the case of the outer periphery. The ECU housing portion 6 may have a large thickness in areas that cover top and bottom surfaces of a circuit board 11 of the ECU 10. This improves rigidity of the ECU housing portion 6.

Figure 9:
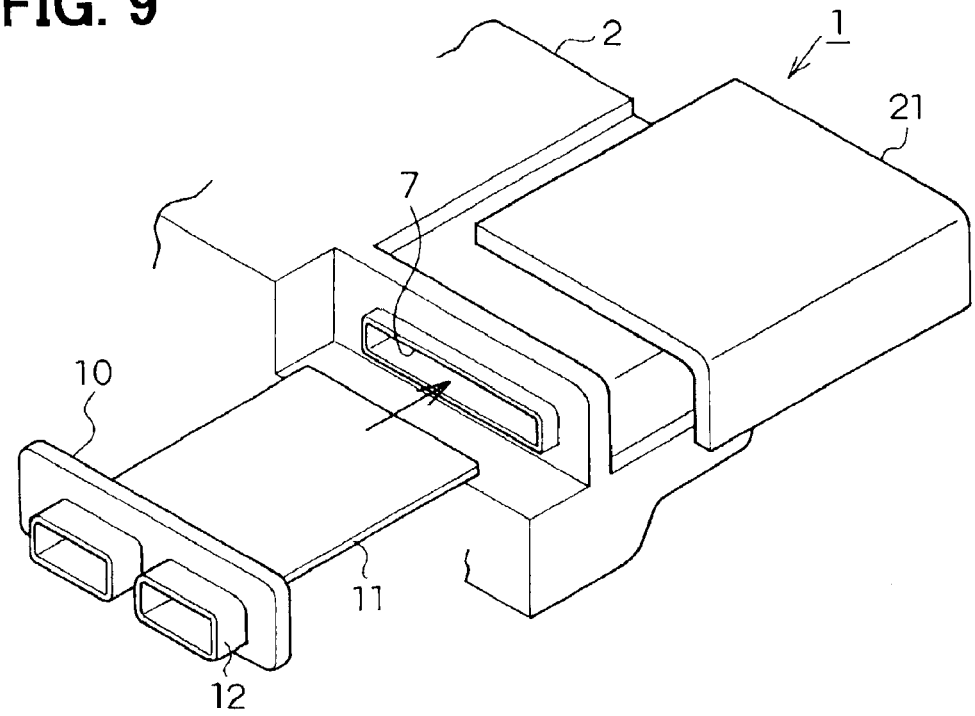
FIG. 9 is a perspective view of a modified intake module.
Figure 10:
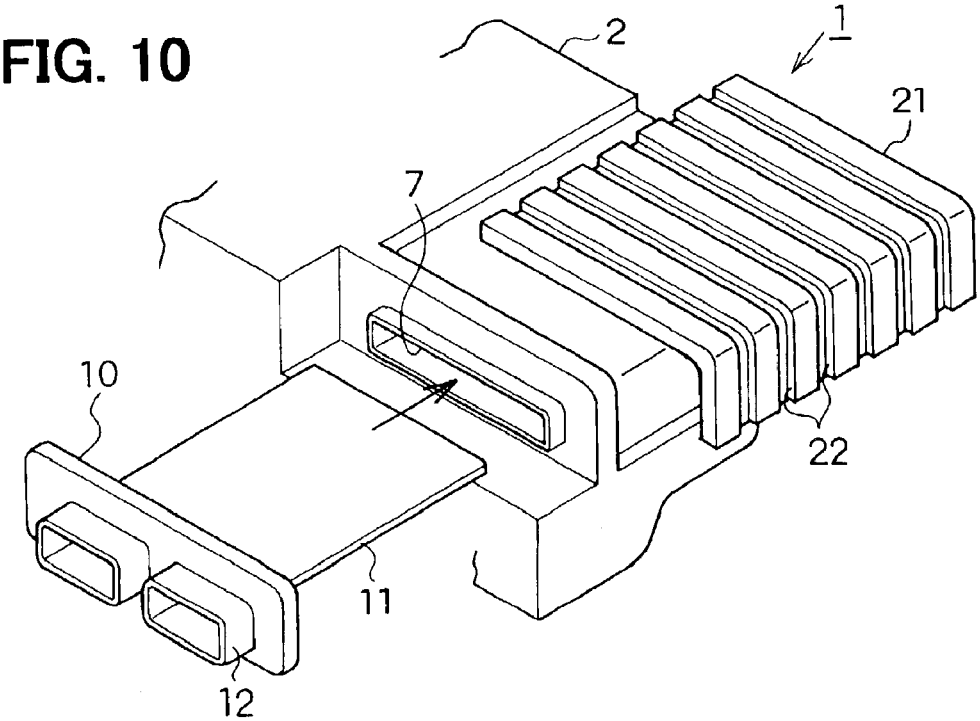
FIG. 10 is a perspective view of a modified intake module.

A separate reinforcement member may be attached to the ECU housing portion 6, for example, a substantially L-shaped reinforcement plate 21 is attached, as shown in FIG. 9. A degree of strength of the reinforcement can be varied as necessary by changing the thickness of the reinforcement plate 21. The reinforcement plate 21 can be a plane plate or a combination of different parts. A plurality of ditches 22 can be formed on the surface of the reinforcement plate 21. When the ECU housing portion 6 and the reinforcement plate 21 are made of the same resin material, they are bonded by the ultrasonic bonding. Alternatively, they are bonded with screws.

The reinforcement plate 21 may be made of different material from the casing 2. For example, the reinforcement plate 21 is made of a metal material, which has higher rigidity than the resin, which is the material the casing 2 is made of. If heat radiation characteristic is considered, the reinforcement plate 21 may be made of copper or aluminum.

Figure 11:
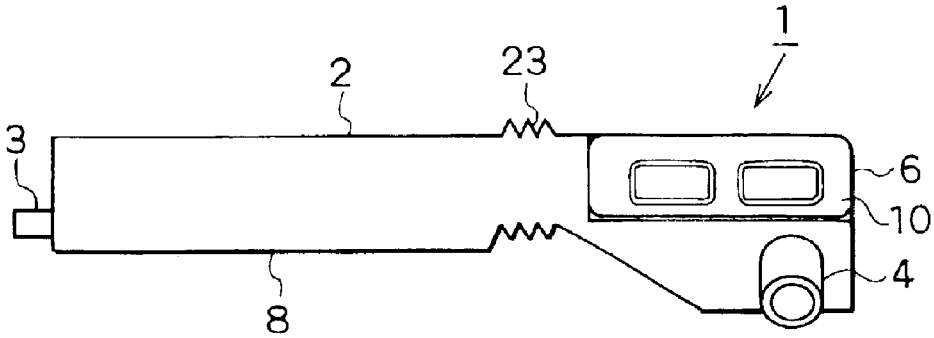
FIG. 11 is a front view of a modified intake module.
Figure 12:
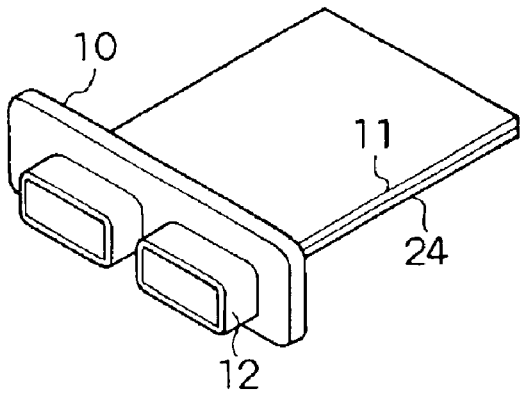
FIG. 12 is a perspective view of an ECU.

A flexible portion may be provided between the air cleaner housing portion 8 and the ECU housing portion 6. More specifically, an accordion-shaped portion 23, which corresponds to the flexible portion, is provided between the air cleaner housing portion 8 and the ECU housing portion 6, as shown in FIG. 11. The accordion-shaped portion 23 absorbs a force applied to the ECU housing portion 6.

The circuit board 11 of the ECU 10 may be sandwiched by reinforcement plates 24. This improves the rigidity of the circuit board 11 and damages to the ECU 10 can be reduced.

What is claimed is:

1. An intake module for a vehicular engine in which an electronic control unit is integrally housed, comprising:

a casing that is constructed of an air cleaner housing portion and an electronic control unit housing portion connected with the air cleaner housing portion; and a reinforcement member that is formed in the electronic control unit housing portion, wherein the casing has a first surface and a second surface;

the first surface of the casing includes the reinforcement member;

the second surface of the casing is located opposite to the first surface and fixed to another part at least in the air cleaner housing portion;

the air cleaner housing portion is provided for housing an air cleaner for a vehicular engine;

the electronic control unit includes a circuit board that has a flat portion;

the electronic control unit housing portion is provided for housing the electronic control unit in such a manner that a surface of the flat portion of the circuit board is parallel to the first surface of the casing; and the casing is arranged such that the flat portion of the circuit board is horizontal to the vehicular engine.

2. The intake module according to claim 1, wherein the reinforcement member is formed on an outer periphery of the electronic control unit housing portion.

3. The intake module according to claim 1, wherein the reinforcement member is formed on an inner periphery of the electronic control unit housing portion.

4. The intake module according to claim 1, wherein the reinforcement member is arranged parallel to a long side of the intake module.

5. The intake module according to claim 1, wherein: the reinforcement member is in a form of reinforcement ribs; the reinforcement ribs are extended from the electronic control unit housing portion; and the reinforcement ribs have a thickness smaller than the casing.

6. The intake module according to claim 1, wherein: the reinforcement member is provided separately from the electronic control unit housing portion; and the reinforcement member is mounted so that it covers the electronic control unit housing portion.

7. The intake module according to claim 6, wherein the reinforcement member is made of a material with higher rigidity than a material of the electronic control unit housing portion.

8. The intake module according to claim 7, wherein the material of the reinforcement member has good heat radiating characteristic.

9. An intake module for a vehicular engine in which an electronic control unit is integrally housed, comprising a casing that is constructed of an air cleaner housing portion and an electronic control unit housing portion connected with the air cleaner housing portion, wherein:

the casing has a first surface and a second surface;

the first surface has a large thickness in the electronic control unit housing portion;

the second surface is located opposite to the first surface and fixed to another part at least in the air cleaner housing portion;

the electronic control unit includes a circuit board that has a flat portion;

the electronic control unit housing portion houses the electronic control unit in such a manner that a surface of the flat portion of the circuit board is parallel to the first surface; and the casing is arranged such that the flat portion of the circuit board is horizontal to the vehicular engine.

10. An intake module for a vehicular engine in which an electronic control unit is integrally housed, comprising a casing that is constructed of an air cleaner housing portion that houses an air cleaner for the vehicular engine, an electronic control unit housing portion that houses an electronic control unit, and a flexible portion, wherein:

the casing has a first surface and a second surface;

the first surface and the second surface are opposed to each other;

the second surface of the casing is fixed to another part at least in the air cleaner housing portion;

the electronic control unit includes a circuit board that has a flat portion;

the electronic control unit housing portion houses the electronic control unit in such a manner that a surface of the flat portion of the circuit board is parallel to the first surface of the casing;

the electronic control housing portion is connected with the air cleaner housing portion via the flexible portion; and the casing is arranged such that the flat portion of the circuit board is horizontal to the vehicular engine.

11. An intake module for a vehicular engine in which an electronic control unit is integrally housed, comprising a casing that is constructed of an air cleaner housing portion and an electronic control unit housing portion connected with the air cleaner housing portion, wherein:

the casing has a first surface and a second surface;

the second surface is located opposite to the first surface and fixed to another part;

the air cleaner housing portion is provided for housing an air cleaner for the vehicular engine;

the electronic control unit housing portion is provided for housing the electronic control unit;

the electronic control unit includes a circuit board that has a flat portion;

the circuit board is reinforced with a reinforcement member that is attached to the flat portion of the circuit board;

the electronic control unit is housed in the electronic control unit housing portion in such a manner that a surface of the flat portion of the circuit board is parallel to the first surface of the casing; and the casing is arranged such that the flat portion of the circuit board is horizontal to the vehicular engine.

12. An electronic control unit for a vehicular engine comprising:

a circuit board having a flat shape on which electronic parts are mounted;

a housing portion in which said circuit board is inserted, a major surface of the house portion covering the flat portion of the circuit board and being arranged in a horizontal direction with respect to the vehicular engine; and a reinforcement member formed in said major surface of the housing portion, wherein said major surface of the housing portion is provided as a hand placement portion for a person, and the reinforcement member in the major surface of the housing portion serves as a protection for the circuit board from downward force applied when a hand is placed on the major surface of the housing portions, and wherein the casing is arranged such that the flat portion of the circuit board is horizontal to the vehicular engine.

13. The electronic control unit according to claim 12, wherein said housing portion is a part integrated into a module unit for the vehicular engine.

14. The electronic control unit according to claim 13, wherein said module unit is provided on the vehicular engine.

15. The electronic control unit according to claim 14, wherein said housing portion is off set from the vehicular engine.

16. The electronic control unit according to claim 14, wherein said module unit is an air intake module for the vehicular engine.

17. The intake module according to claim 1, wherein the electronic control unit housing portion is arranged away from where the air cleaner housing portion is fixed.

18. The intake module according to claim 9, wherein the electronic control unit housing portion is arranged away from where the air cleaner housing portion is fixed.

19. The intake module according to claim 10, wherein the electronic control unit housing portion is arranged away from where the air cleaner housing portion is fixed.

20. The intake module according to claim 11, wherein the electronic control unit housing portion is arranged away from where the air cleaner housing portion is fixed.

21. The intake module according to claim 1, wherein said another part is the vehicular engine.

22. The intake module according to claim 9, wherein said another part is the vehicular engine.

23. The intake module according to claim 10, wherein said another part is the vehicular engine.

24. The intake module according to claim 11, wherein said another part is the vehicular engine.

25. The intake module according to claim 21, wherein the casing is formed in a flat shape and is arranged on the vehicular engine.

26. The intake module according to claim 22, wherein the casing is formed in a flat shape and is arranged on the vehicular engine.

27. The intake module according to claim 23, wherein the casing is formed in a flat shape and is arranged on the vehicular engine.

28. The intake module according to claim 24, wherein the casing is formed in a flat shape and is arranged on the vehicular engine.

29. The intake module according to claim 1, wherein the reinforcement member has a good heat radiating characteristic.

30. The intake module according to claim 1, wherein the electronic control unit housing portion has a slot for housing the circuit board, and the slot is closed by a part of the electronic control unit including a connector for electrical connection with an external device, the connector protruding from the casing.

31. The intake module according to claim 9, wherein the electronic control unit housing portion has a slot for housing the circuit board, and the slot is closed by a part of the electronic control unit including a connector for electrical connection with an external device, the connector protruding from the casing.

32. The intake module according to claim 10, wherein the electronic control unit housing portion has a slot for housing the circuit board, and the slot is closed by a part of the electronic control unit including a connector for electrical connection with an external device, the connector protruding from the casing.

33. The intake module according to claim 11, wherein the electronic control unit housing portion has a slot for housing the circuit board, and the slot is closed by a part of the electronic control unit including a connector for electrical connection with an external device, the connector protruding from the casing.

* * * * *